US011131106B2

(12) United States Patent
Milton et al.

(10) Patent No.: US 11,131,106 B2
(45) Date of Patent: Sep. 28, 2021

(54) CONTAINMENT SHROUD SYSTEM

(71) Applicants: Stephen Val Milton, Fort Collins, CO (US); Sandra Gail Biedron, Fort Collins, CO (US); Samantha Christine Schaffer, Fort Collins, CO (US)

(72) Inventors: Stephen Val Milton, Fort Collins, CO (US); Sandra Gail Biedron, Fort Collins, CO (US); Samantha Christine Schaffer, Fort Collins, CO (US)

( * ) Notice: Subject to any disclaimer, the term of this patent is extended or adjusted under 35 U.S.C. 154(b) by 0 days.

(21) Appl. No.: 15/448,574

(22) Filed: Mar. 2, 2017

(65) Prior Publication Data

US 2017/0254103 A1 Sep. 7, 2017

Related U.S. Application Data

(60) Provisional application No. 62/302,175, filed on Mar. 2, 2016.

(51) Int. Cl.
*E04G 21/24* (2006.01)
*E04G 21/28* (2006.01)
(Continued)

(52) U.S. Cl.
CPC ..... *E04G 21/242* (2013.01); *B08B 15/02* (2013.01); *B08B 17/04* (2013.01); *E04G 21/28* (2013.01);
(Continued)

(58) Field of Classification Search
CPC ..... E04G 21/242; E04G 21/28; E04G 5/001; E04G 21/3204; E04G 23/02; E04H 12/00
See application file for complete search history.

(56) References Cited

U.S. PATENT DOCUMENTS 4,033,367 A * 7/1977 Johnston ..... A01G 9/18 135/100
4,794,974 A * 1/1989 Melino ..... A47H 21/00 160/327
(Continued)

FOREIGN PATENT DOCUMENTS

JP 60250171 A 12/1985

OTHER PUBLICATIONS

"Universal Tower Leg Mounts", http://advancedtowercomponents.com/store/Universal-Tower-Leg-Mounts.html, 2014.

*Primary Examiner* — Brian D Mattei
*Assistant Examiner* — Omar F Hijaz
(74) *Attorney, Agent, or Firm* — Peacock Law P.C.; Philip D. Askenazy

(57) ABSTRACT

An apparatus and method for the containment of vertical structures using a flexible, collapsible, and movable shroud. The shroud containment system protects the surrounding environment by catching liquid and solid debris and contaminants from the inside and protects the enshrouded structure and workers from wind, debris, contaminants, and precipitation on the outside as well as providing enhanced protection against falling persons and equipment. The shroud also conceals the vertical structure in whole or in part and greatly eases the setup, takedown, and relocation of the shroud along the axis of the vertical structure due to its modular, impermanent design and method of erection, collapse, and translation.

17 Claims, 16 Drawing Sheets

(51) Int. Cl.

| | |
|---|---|
| ***E04G 21/32*** | (2006.01) |
| ***E04G 23/02*** | (2006.01) |
| ***E04H 12/00*** | (2006.01) |
| ***E04G 5/00*** | (2006.01) |
| ***B08B 15/02*** | (2006.01) |
| ***B08B 17/04*** | (2006.01) |
| ***E04G 21/30*** | (2006.01) |
| *E04G 5/12* | (2006.01) |

(52) U.S. Cl.
CPC ..... *E04G 21/30* (2013.01); *E04G 21/3204* (2013.01); *E04G 23/02* (2013.01); *E04H 12/00* (2013.01); *E04G 5/001* (2013.01); *E04G 5/12* (2013.01); *E04G 2021/248* (2013.01)

(56) References Cited

U.S. PATENT DOCUMENTS 5,033,240 A * 7/1991 Richard ..... B08B 17/02 52/63
5,161,641 A * 11/1992 Nusbaum ..... E04G 21/3223 182/129
5,211,125 A 5/1993 Garland et al.
5,285,603 A 2/1994 Richard et al.
5,291,695 A * 3/1994 Healy ..... B24C 3/065 451/89
6,029,405 A * 2/2000 Wood ..... E04H 3/14 52/2.23
6,070,371 A * 6/2000 Myrick ..... E04G 21/28 160/352
6,360,490 B1 * 3/2002 Cotriss ..... B08B 15/02 52/138

* cited by examiner

CONTAINMENT SHROUD SYSTEM

CROSS-REFERENCE TO RELATED APPLICATIONS

This application claims priority to U.S. Provisional Application No. 62/302,175 filed Mar. 2, 2016. The content of the above application is incorporated by reference in its entirety.

FIELD OF THE DISCLOSURE

This disclosure relates generally to the field of enclosure of vertical structures.

BACKGROUND

Many structures and buildings require work, repair, or maintenance. There are times that during the course of this work, repair, or maintenance that the building or structure must be properly enclosed for materials containment or concealment purposes as well as to mitigate safety concerns for construction workers. In such cases a temporary structure—such as a shroud—may be useful.

Current solutions include shroud-like structures to conceal large and/or vertical structures; however, they do not provide flexibility, maneuverability, and re-configurability on-site. Existing shroud systems utilize booms in order to keep the shroud in place on the vertical structure, but do not allow for the shroud to remain essentially free of the vertical structure; to be reconfigured and/or collapsed; and to have the ability to move along the length of the structure. Such existing shroud systems cannot readily be modified based on wind conditions to account for structural strength variability of specific portions of the structures. Such existing shroud systems are not suitable for tall communications, broadcast, or substantially vertical towers/antennas because enclosing the entire structure would be unsafe due to structural loads induced by the wind.

A few published patents and applications disclose similar devices; however, each suffers from one or more of the abovementioned shortcomings. U.S. Pat. No. 6,070,371 A is designed for use on a water tower structure. This shroud attaches to the top of the tower and hangs as a sheet around the tower for concealment. This patent application does not address environmental safety, containment of work debris, physical/personnel safety, or vertical maneuverability. As well, this patent application does not allow for portions of the structure to be worked on and concealed and protected, nor does it allow the shroud system to change its size or degree of tensioning to account for other factors, such as wind conditions. This patent does not address and is not primarily concerned with environmental and worker safety, containment of work debris, the personal safety of workers and pedestrians nearby, and vertical maneuverability. Lastly, this system does not utilize booms and forming structure in order to maintain the shroud at a specified distance from the structure for work purposes.

U.S. Pat. No. 5,033,240 A is a shroud system that is attached to the top of a vertical structure and then mounted to the ground. It works on a pulley system to come up or down as one piece (with limited ability to collapse in the air); it cannot move vertically along a structure; and it does not protect the environment by containment of materials within the shroud system. The booms on the structure are used for support and do not utilize any materials that keep the shroud off or away from the tower during work that requires such (for example: to allow coatings to be applied to a tower and then dried without the shroud lying against it). This shroud system can only be lowered to the ground, rather than raised or collapsed at some point off of the ground. This patent does not address and is not primarily concerned with environmental and worker safety, containment of work debris, the personal safety of workers and pedestrians nearby, and vertical maneuverability.

U.S. Pat. No. 5,211,125 A is a shroud system specific for concealing the hull of a ship during work. This shroud system does not work on a pulley system but rather mounts directly to the ship's hull. Additionally, this patent application does not include a bottom for waste containment and environmental protection.

For the foregoing reasons, there is a need for a shroud containment system which provides for containment of debris and environmentally hazardous materials from the top of the enclosed structure to the bottom as well as a system the provides nearly complete protection for workers and the structure inside the shroud from environmental hazards such as wind, blowing dust, or rain; in many cases there may also be the desire for concealment from the general public of the construction endeavor provided by such a shroud containment system. There is also a further need for a shroud system which can catch or slow and thereby mitigate the damage and impact of falling debris, equipment, or even people. There is also a need for a containment shroud which possesses ease of repositioning and configuration so that said containment system need not be deconstructed and reconstructed at each phase, providing substantial realizable gains in project time management and labor and equipment costs.

SUMMARY

The present invention allows for temporary concealment and containment of vertical structures. It can be readily moved, resized, collapsed, and relocated by personnel or machine. The present invention allows for shroud components to change in both size and type in order to accommodate the work being performed within, and without requiring the entire system to be dismantled. Further, the present invention accounts for wind loads or other forces by allowing the size and location of the shroud to change, therefore avoiding overstressing the structure from wind forces. In addition, the present invention is unique as it allows for the shroud to remain offset from the vertical structure by forming structures that keep it at a specified distance away from the structure. The present invention shields and contains harmful contaminants from getting into the air or the surrounding environment and thus enhances the personal safety of those in the area breathing the air or coming into contact with the ground and environment; the present invention adds a significant measure of safety by providing protection against workers who may fall from the enshrouded structure as well as catching or breaking the fall of flying debris, equipment, and contaminants. Conversely, this invention protects those within the shroud as well as the structure itself by blocking external contaminants, debris, wind, and precipitation from passing through the shroud's barrier. By utilizing a system that expands and collapses by hand or mechanical means, the present invention can be moved vertically, provide flexibility for the structure's wind loads by being able to adjust the shroud's location and size, while at the same time providing material containment and concealment.

Movement, transitioning, and re-configurability are all new features of this invention. The ability of this shroud system to move or be reconfigured in place is completely unique. With such capability, this shroud system can be readily adapted to both the task and the structure to which it is attached. For instance, communications towers tend to be very tall with a very small horizontal cross-section. Applying a full-length shroud to such a structure is not advisable and in fact would immediately present a safety issue in the wind due to the applied wind loads. This new shroud system would allow one to use a much smaller shroud that can transition along the length of the vertical structure and allow for completion of all work along the length of the structure.

In some embodiments, the preceding and following embodiments and descriptions are for illustrative purposes only and are not intended to limit the scope of this disclosure. Other aspects and advantages of this disclosure will become apparent from the following detailed description.

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

BRIEF DESCRIPTION OF THE DRAWINGS

Embodiments of the present disclosure are described in detail below with reference to the following drawings. These and other features, aspects, and advantages of the present disclosure will become better understood with regard to the following description, appended claims, and accompanying drawings. The drawings described herein are for illustrative purposes only of selected embodiments and not all possible implementations and are not intended to limit the scope of the present disclosure. Also, the drawings included herein are considered by the applicant to be informal.

DEFINITIONS

Figure 1:
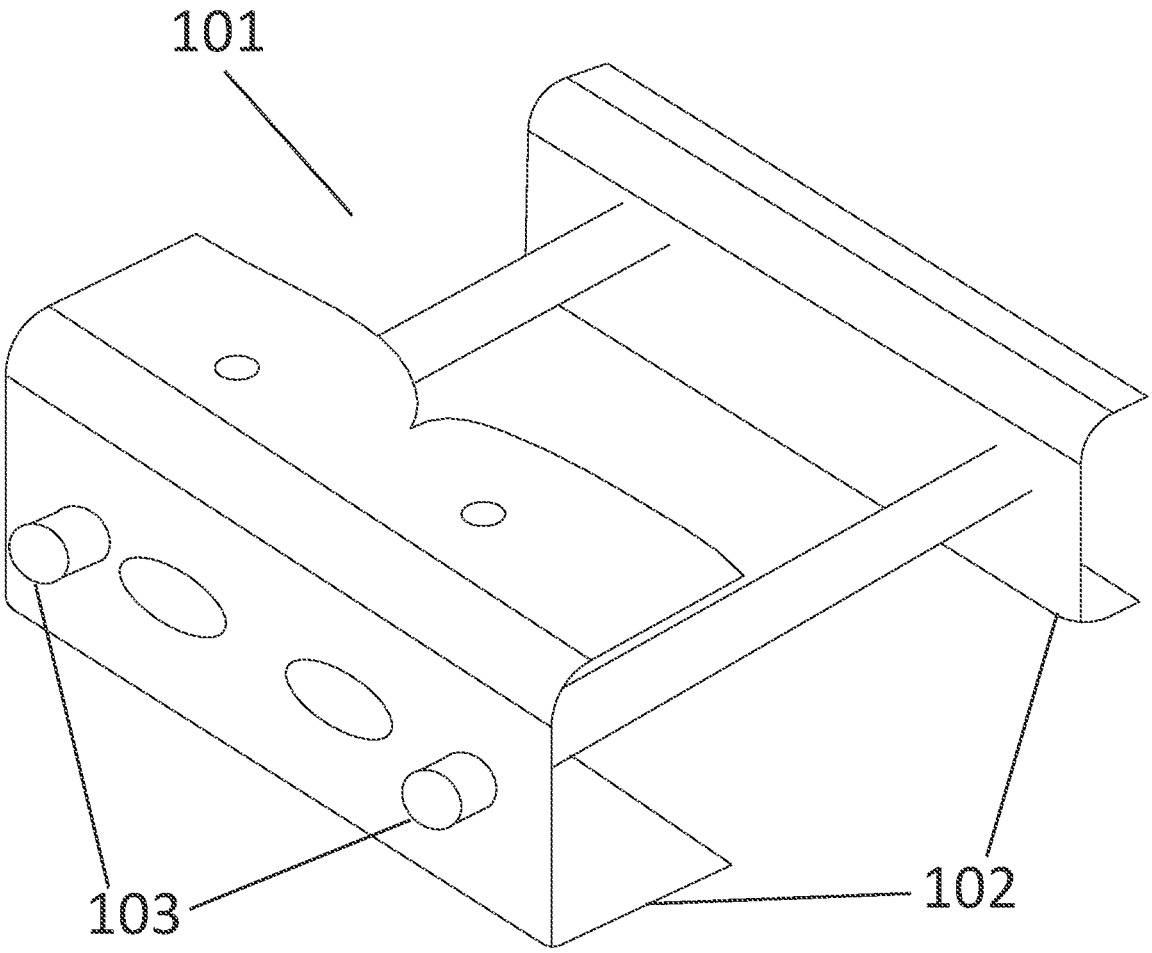
FIG. 1 is a block diagram of a preferred embodiment of a boom support module.

Concealment: A cover; the ability to hide something or prevent it from being seen.

Containment: The ability to keep harmful or other contaminants under control or within limits by limiting/preventing environmental exposure.

Vertical Structure: A structure, either immovable or movable, in any shape or configuration, with a non-flat vertical dimension.

Shroud: A structure, generally made of some type of textile either naturally occurring or human made, that can enclose a vertical structure, or some portion thereof, generally to permit work to be performed on the enclosed section of the vertical structure or structures attached thereon.

Shroud System: An integrated network of supports, tarps, pulleys, ropes, and associated peripherals to translate, collapse or otherwise support a shroud on one or more vertical structures.

Tarp: A section of the shroud.

Forming Structure: A rigid hoop (in the preferred embodiment), which maintains the cross-section of the shroud.

Rope: A device providing tensile and/or compressive strength across distances between one or more end points or objects including but not limited to twisted or braided fabric, fiber, wire threads, or linked discrete segments in a chain.

Haul Rope: A primary rope used to move the shroud system along the vertical length of the vertical structure and to collapse the shroud in place.

Knot Rope: A primary rope used to hold the forming structures spaced and stationary vertically along the vertical structure.

Static Rope: A rope used to assist in the vertical collapse and extension of the shroud and keeps the forming structures aligned when the tensioning lines have been removed.

Tensioning Rope: A short rope attached from the forming structures to the vertical structure which assist in securing the forming structures transversely.

Short Rope: A temporary Rope used to release tension during the movement of the haul rope between positions.

Stand-Off: A structural means by which uniform positive separation between two adjacent materials is achieved.

DETAILED DESCRIPTION

In the Summary above and in this Detailed Description, and the claims below, and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

The term "comprises" and grammatical equivalents thereof are used herein to mean that other components, ingredients, steps, among others, are optionally present. For example, an article "comprising" (or "which comprises") components A, B and C can consist of (i.e., contain only) components A, B and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range beginning with that number (which may be a range having an upper limit or no upper limit, depending on the variable being defined). For example, "at least 1" means 1 or more than 1. The term "at most" followed by a number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)-(a second number)," this means a range whose limit is the second number. For example, 25 to 100 mm means a range whose lower limit is 25 mm and upper limit is 100 mm.

The present disclosure is generally drawn, inter alia, to a shroud system to enclose sections of vertical structures for containment and concealment purposes. This shroud system is unique in that it can be readily moved up and down along the length of the structure based on the needs and location of the work to be done. It can be constructed to a convenient vertical work length and horizontal size, but can also be reconfigured in place from fully extended to fully collapsed, or any length in between. It provides full enclosure for sides, bottom, and top if necessary. The preferred embodiment of the system comprises booms mounted directly to the structure; forming structure made of a strong material such as steel; tarps, both permeable and impermeable, of a material compatible for the work being performed; and a system of ropes and pulleys.

The booms support the entire structure, and are extended to a distance from the vertical structure to hold the shroud off the structure that is being shrouded. The forming structures and ropes are used to build the shroud skeletal structure. The ropes are also used with the pulleys to provide the system the ability to be moved and reconfigured. The tarps are used for enclosure.

In some embodiments, there are no forming structures at all and the ropes at the ends of the tarp and legs are tied off directly to the booms at the top and bottom of the shroud containment system.

The tubular shape of the shroud system can be modified to fit the vertical structure to include a quadrilateral or triangular configuration of the vertical structure (as these are the most common). However, the shroud system can be configured for a vertical structure of any cross-sectional shape.

In some embodiments, the booms described herein can be removed and the shroud can be attached directly to the structure using lines and pulleys. The difference is that this configuration does not provide as much support for maintaining a stand-off between the shroud and the vertical structure.

The present invention functions for concealment and containment purposes of vertical structures. It has the ability to be tensioned using lines and pulleys and allows for the flexibility of being relocated, collapsed, extended, and transitioned vertically by both personnel and mechanical means.

The present invention is a shroud system to enclose sections of vertical structures for containment and concealment purposes. This shroud system is unique in that it can be readily moved up and down along the length of the structure based on the needs and location of the work to be done. It can be constructed to a convenient vertical work length and horizontal size, but can also be reconfigured in place from full extension to fully collapsed, or any length in between. It provides full enclosure for sides, bottom, and top if necessary. The preferred embodiment of the system comprises booms mounted directly to the vertical structure; forming structure(s) made of a strong material such as steel; tarps, both permeable or impermeable, of a material compatible for the work being performed; and a system of ropes and pulleys. The booms support the entire structure, and are extended horizontally from the plane of the vertical structure to a certain distance to hold the shroud off the structure that is being shrouded. The forming structures and ropes are used to build the shroud's skeletal structure. The ropes are also used with the pulleys to provide the system the ability to be moved and reconfigured. The tarps are used for enclosure. The tubular shape of the shroud system can be modified to fit the vertical structure to include a cylindrical, quadrilateral, or triangular configuration of the vertical structure (as these are the most common); however, the shroud system can be configured for a vertical structure of any cross-sectional shape. The material used for the tarps is flexible and can be made from both permeable or impermeable material. The material can be appropriately typed in order to prevent certain contaminants, debris, and other objects from penetrating through the outside and the inside as well as to catch falling debris, contaminants such as dust or chemical sprays, persons, or equipment that detach from the vertical structure from within the shroud. The material chosen for the tarp may be human made or naturally occurring. The pulley system, booms, and rings allow the system to adapt to its environment and for necessity. This shroud system can easily be lowered, relocated, and collapsed on itself and does not require to be completely removed from the vertical structure to perform these functions. Additionally, the shroud may either encase an entire structure or only a portion of same, and in the case of the latter, may be readily repositioned up or down the structure without deconstruction of the entire shroud system.

The invention described herein includes any type of knots appropriate to the application including but not limited to Prusik, trucker's hitch, buntline, cleat, cow, half hitch, and tumble hitch knots.

FIG. 1 is a block diagram of a preferred embodiment of a boom support attachment module. FIG. 1 includes boom support attachment module 101 which is comprised of two C-shaped plates 102 which are bolted together using at least two pairs of nuts and bolts 103 to attach the boom support to the vertical structure (not shown).

Figure 2:
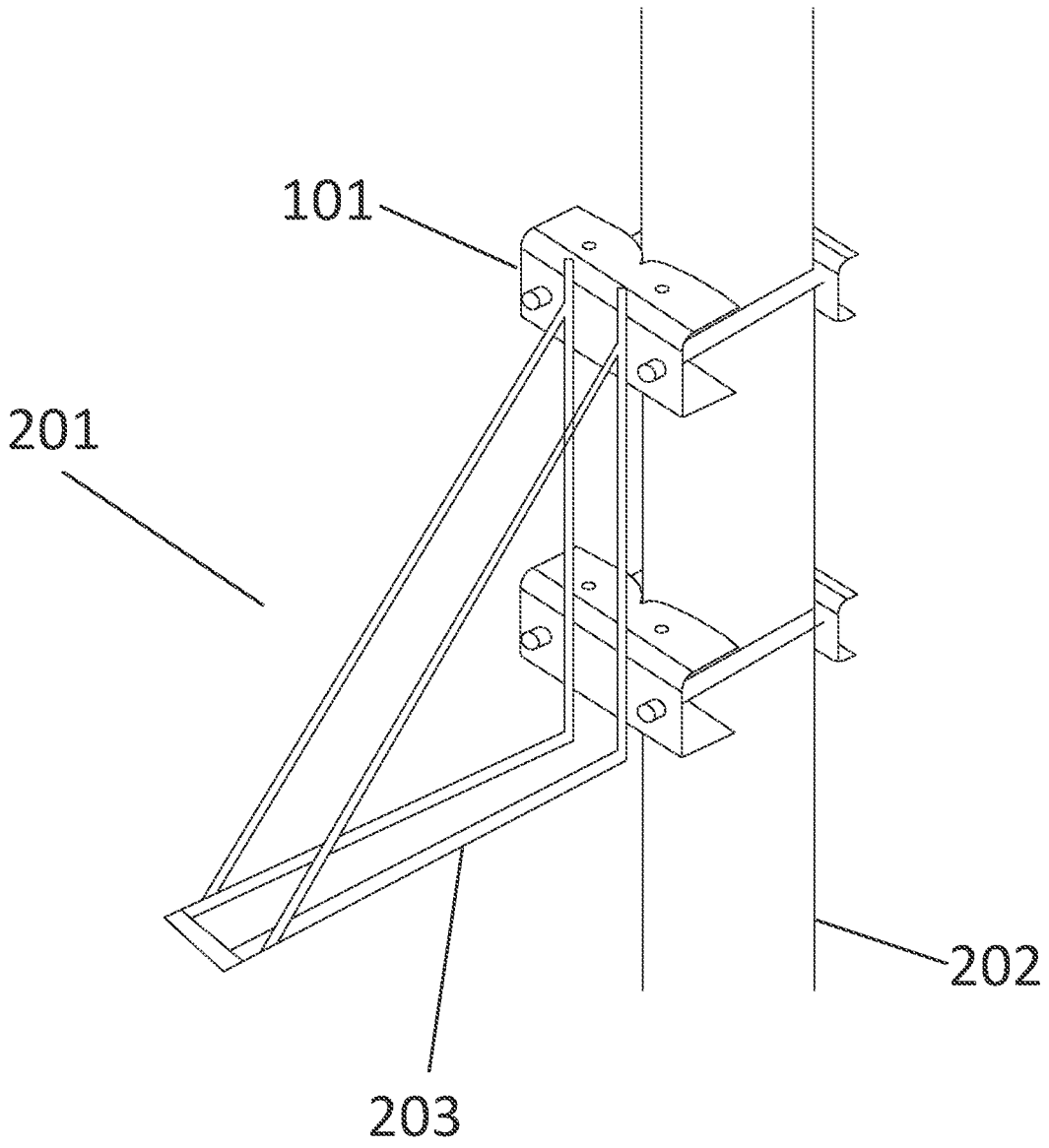
FIG. 2 is a block diagram of a preferred embodiment of a full boom support.

FIG. 2 is a block diagram of a preferred embodiment of a full boom support. FIG. 2 includes a boom support 201 consisting of at least two boom support modules 101 secured to the vertical support structure 202. The boom support modules support beams 203 which are arrayed in a simple truss-like configuration.

In FIG. 2, the boom supports are preferably constructed out of metal, such as iron or steel, and are designed and tested to hold and correctly position the entire load of the shroud system. The boom material can also be constructed out of other appropriate weight bearing materials, such as titanium, aluminum composite, carbon fiber composite, or other weight bearing solid material. In the preferred embodiment, the booms are attached to the vertical structure using a mount such as Universal Tower Mounts which are manufactured by Advanced Tower Components™. By utilizing these mounts and booms together, the user need remove only one bolt from the mount to relocate the shroud system if necessary while working at heights which minimizes the potential for dropping the mounting materials and reduces the possibility of fall hazards at height. These specific tower mounts are not necessary for the boom system, which can be configured to fit around one or more legs without the use of an additional mount.

Figure 3:
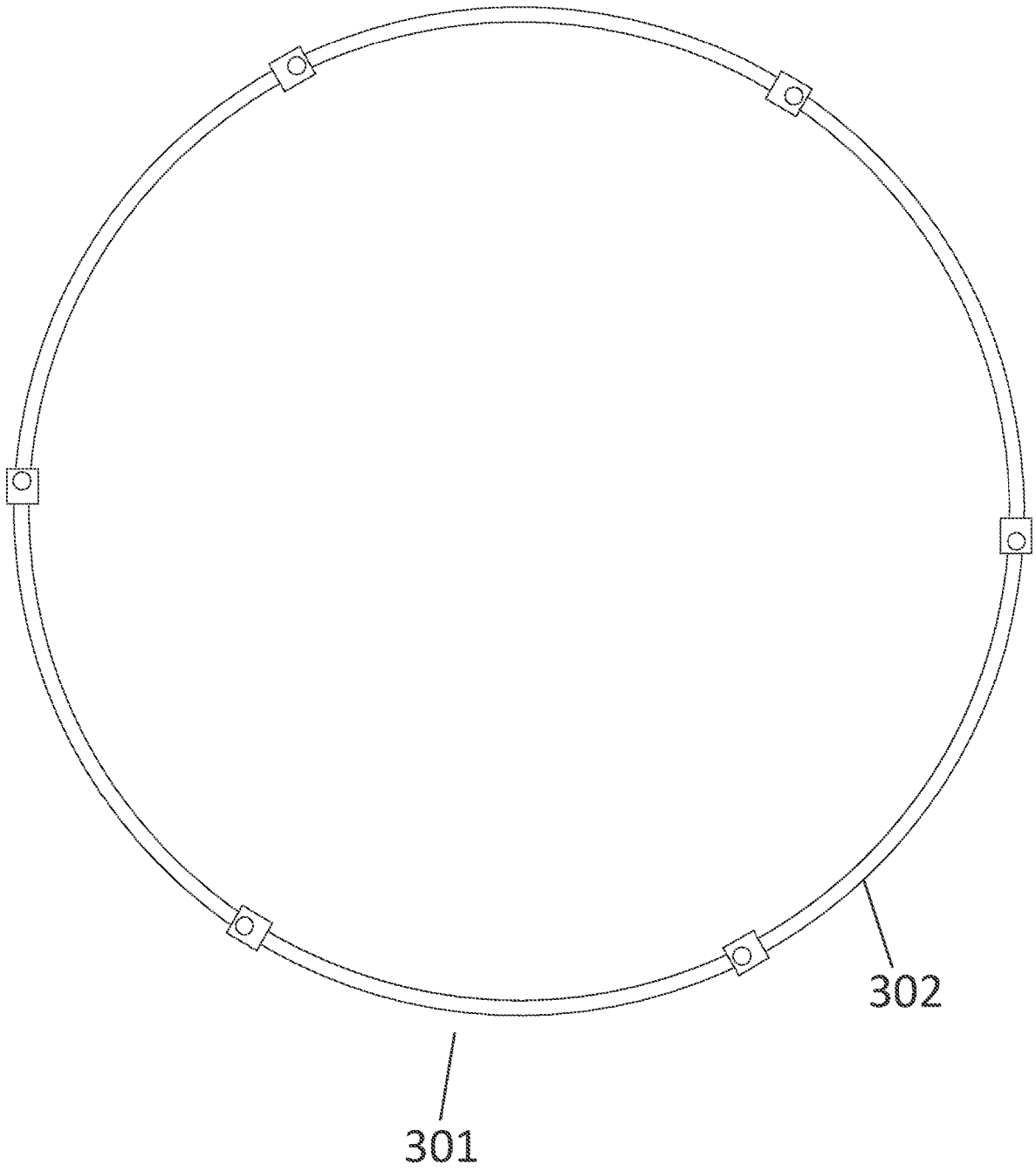
FIG. 3 is a block diagram of a preferred embodiment of a forming structure.

FIG. 3 is a block diagram of a preferred embodiment of a forming structure 301. FIG. 3 includes a forming structure 301 composed of at least 3 or more curved segments 302.

In FIG. 3, the forming structure may be comprised of any suitable shape created by one or more connected modules such as a circular ring or a cross-sectional shape.

In the preferred embodiment, the forming structures are made of two or more curved or straight sections that, when connected end-to-end by one or more sleeves, form a rigid circle, ring, or cross-sectional shape. Forming structure sections are preferably made of metal, such as steel or aluminum, but other rigid materials may also work such as high-strength plastics, carbon fiber, and PVC piping.

In the preferred embodiment, the forming structure provides an internal rigid structure for the shroud, enabling maintaining of a gap between the shroud and the vertical structure.

In alternative embodiments, the shroud system does not contain any boom supports and forming structures; instead, the tarp is secured directly to the vertical structure by any suitable means including but not limited to clipping with carabiners, stapling, chemical adhesion with liquid or tape adhesives, magnetism, tying off with ropes or ties, thermal bonding, nailing, or bolting. This configuration exchanges maintenance of an enforced gap between the tarp and the vertical structure for maximum flexibility and freedom of movement for the shroud.

Figure 4:
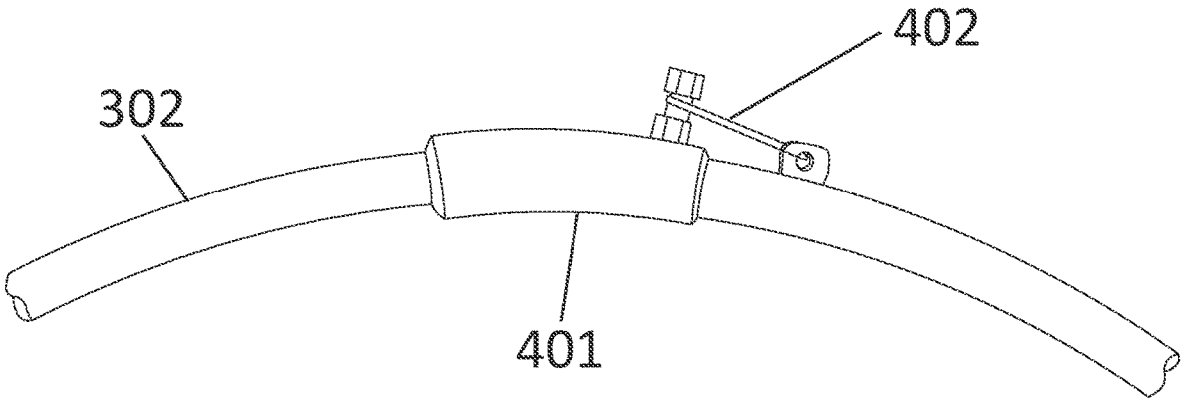
FIG. 4 is a block diagram of a close-up view of a preferred embodiment of a sleeve locked with a set bolt connecting two forming structure modules.

FIG. 4 is a block diagram of a close-up view of a preferred embodiment of a locking sleeve connecting two forming structure segments. FIG. 4 includes a forming structure connection sleeve 401, forming structure segments 302, and a locking mechanism 402.

In FIG. 4, the locking mechanism may be comprised of a screw latch or other suitable locking mechanism. In the preferred embodiment an integral eyelet in the forming structure is connected with a safety wire to a bolt and nut attachment with the locking sleeve body.

Figure 5:
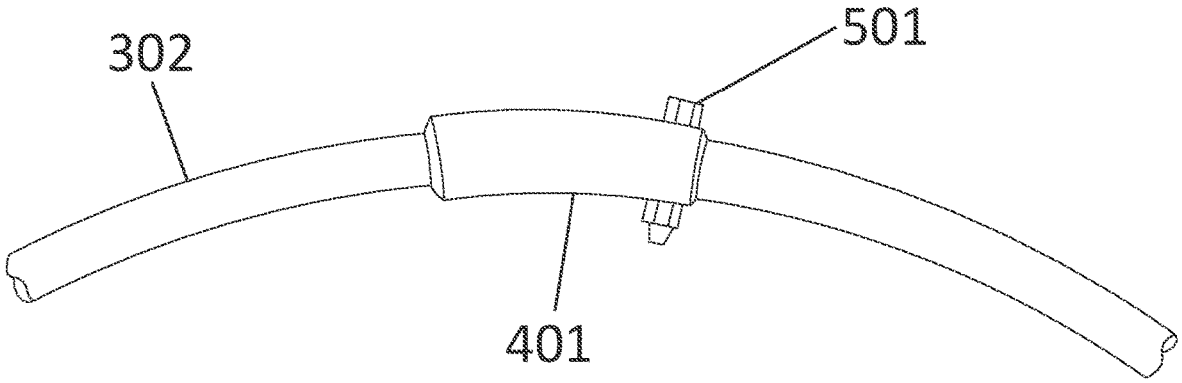
FIG. 5 is a block diagram of a close-up view of a preferred embodiment of a stationary sleeve locked with a through-bolt and nut mechanism.

FIG. 5 is a block diagram of a close-up view of a preferred embodiment of a stationary sleeve with a locked, locking mechanism. FIG. 5 includes forming structure segments 302, forming structure sleeve 401, and a fastener 501.

In FIG. 5, the fastener may be comprised of a nut and bolt, screw and bolt, or other appropriate securing mechanism.

In the preferred embodiment, various types of sleeves may be used to connect one or more sections of the forming structure together.

Figure 6:
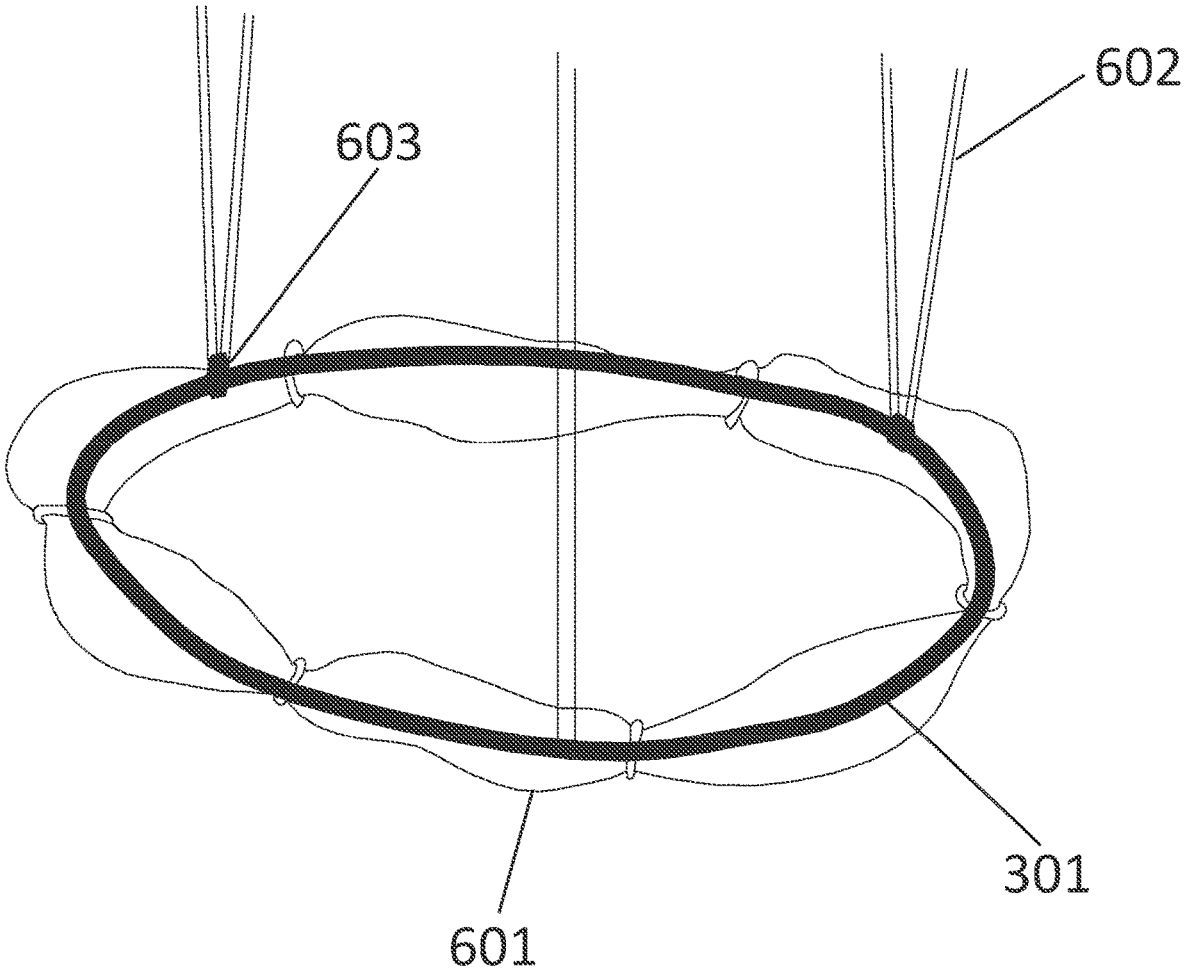
FIG. 6 is a block diagram of a preferred embodiment of a forming structure secured to a rope and pulley system with collapsed shroud.

FIG. 6 is a block diagram of a preferred embodiment of a forming structure connected to ropes and pulleys. FIG. 6 includes forming structure 301, tarps 601, haul ropes 602, and pulleys 603. At least three sets of ropes and pulleys are connected to the forming structure to allow for raising and lowering the forming structure and tarps. In FIG. 6, the material used for the tarps is flexible and can be made from both permeable or impermeable material such as fabric, plastic, or metal in either solid planes or woven such as in a chain-link fence like structure or a tightly woven textile. The material chosen for the tarp may be human made or naturally occurring and is chosen considering factors specific to the intended use scenario including but not limited to the anticipated forces that will be exerted upon the shroud from falling debris including persons, environmental conditions such as wind and precipitation, and impermeability to contaminants such as liquids, gasses, and particulates from both environment and the vertical structure enshrouded by the containment system.

In FIG. 6, the forming structure is connected to and supports the collapsed tarps. The tarps may be secured to the forming structure by any suitable connective means such as clipping with carabiners, stapling, chemical adhesion with liquid or tape adhesive, thermal bonding, magnetism, tying off with ropes or ties, nailing, or bolting.

In the preferred embodiment, the tarps are tied to the forming structures with ropes. The ropes are knotted directly to the forming structures or to pulleys connected to the forming structures either directly or with additional knotted short ropes.

In alternative embodiments, the tarps are secured to the forming structures by any suitable means including but not limited to clipping with carabiners, stapling, chemical adhesion with liquid or tape adhesives, magnetism, tying off with ropes or ties, thermal bonding, nailing, or bolting.

In the preferred embodiment, ropes and pulleys provide the system the ability to move and reconfigure while at the same time holding the forming structure and tarp system firmly in place. The haul ropes and knot ropes are two primary sets of ropes used. The haul ropes attach through a pulley system to both the forming structure and boom structure. The number of ropes used to raise, lower and reconfigure the shroud system depends on the number of legs on the vertical structure and the shape of the forming structures.

In the preferred embodiment, at least three individual haul lines are deployed. In alternative embodiments, a single haul line connected via a greater plurality of pulleys is used to accomplish lowering, raising, and repositioning of the shroud.

In the preferred embodiment, additional static ropes may be deployed to augment the haul and knotted ropes in order to guide the forming structure up and down during transitioning, reconfiguring, or collapsing the system. Additional tensioning lines may also be deployed throughout the system to hold the forming structures firmly in place with respect to the vertical structure and to also tension the tarps to the forming structures.

Figure 7:
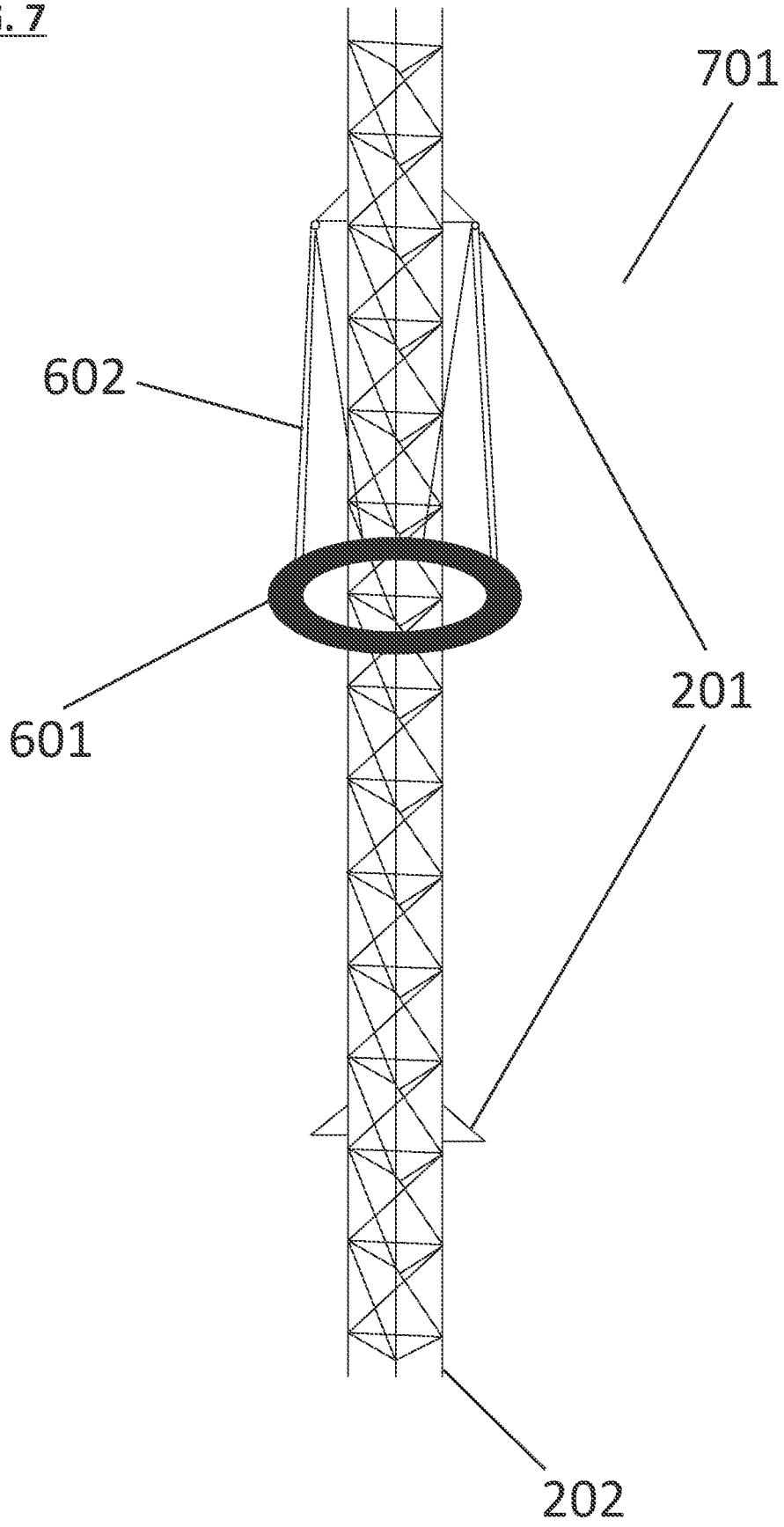
FIG. 7 is a block diagram of an entire shroud containment system showing the tarp collapsed on the top forming structure.

FIG. 7 is a block diagram of a preferred embodiment of an entire shroud containment system 701 showing the tarp collapsed at the top forming structure. FIG. 7 includes vertical structure 202, boom supports 201, tarps 601, and ropes 602.

In FIG. 7, the booms support the shroud system by supporting three sets of ropes, which connect to and support the structure attachments on the top forming structure (not shown), which in turn holds the entire shroud assembly.

In the preferred embodiment, the vertical structure is comprised of a guyed, triangular broadcast tower type structure such as a telecommunications tower.

In alternative embodiments, the vertical structure may be comprised of a mobile structure such as a structure mounted to a land or water vehicle.

In alternative embodiments, the vertical structure may be comprised of a temporary structure such as scaffolding erected around another structure such as a building.

In alternative embodiments, the vertical structure may be non-triangular and instead can be circular or of an arbitrary cross-sectional shape.

Figure 8:
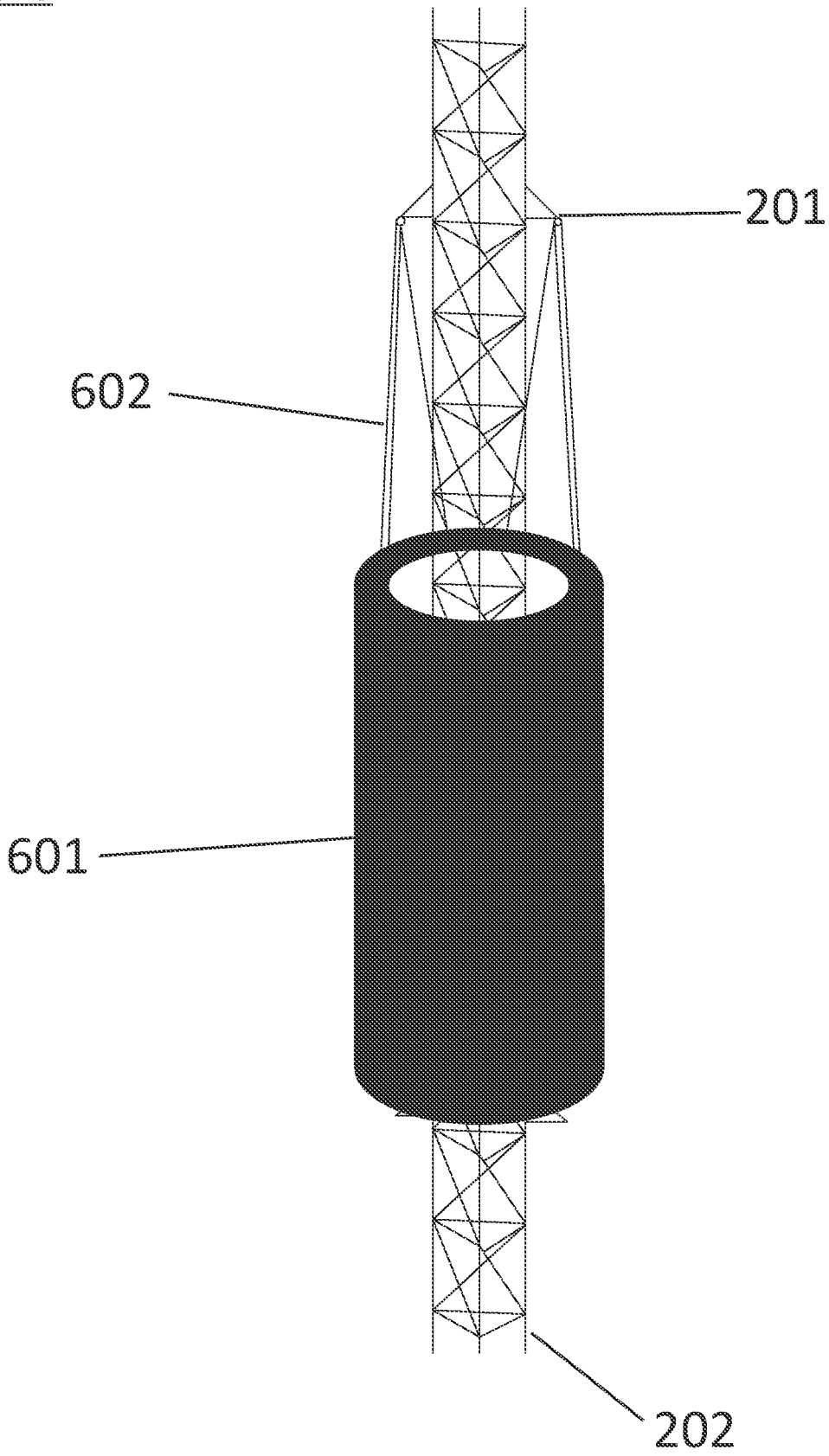
FIG. 8 is a block diagram of a preferred embodiment of the shroud system fully extended.

FIG. 8 is a block diagram of a preferred embodiment of the shroud system fully extended. FIG. 8 includes vertical structure 202, boom supports 201, tarps 601, and ropes 602.

In FIG. 8, two sets of booms, three on top holding the shroud system and three on bottom which (as shown) may optionally be attached to the shroud system at the lower forming structure.

Figure 9:
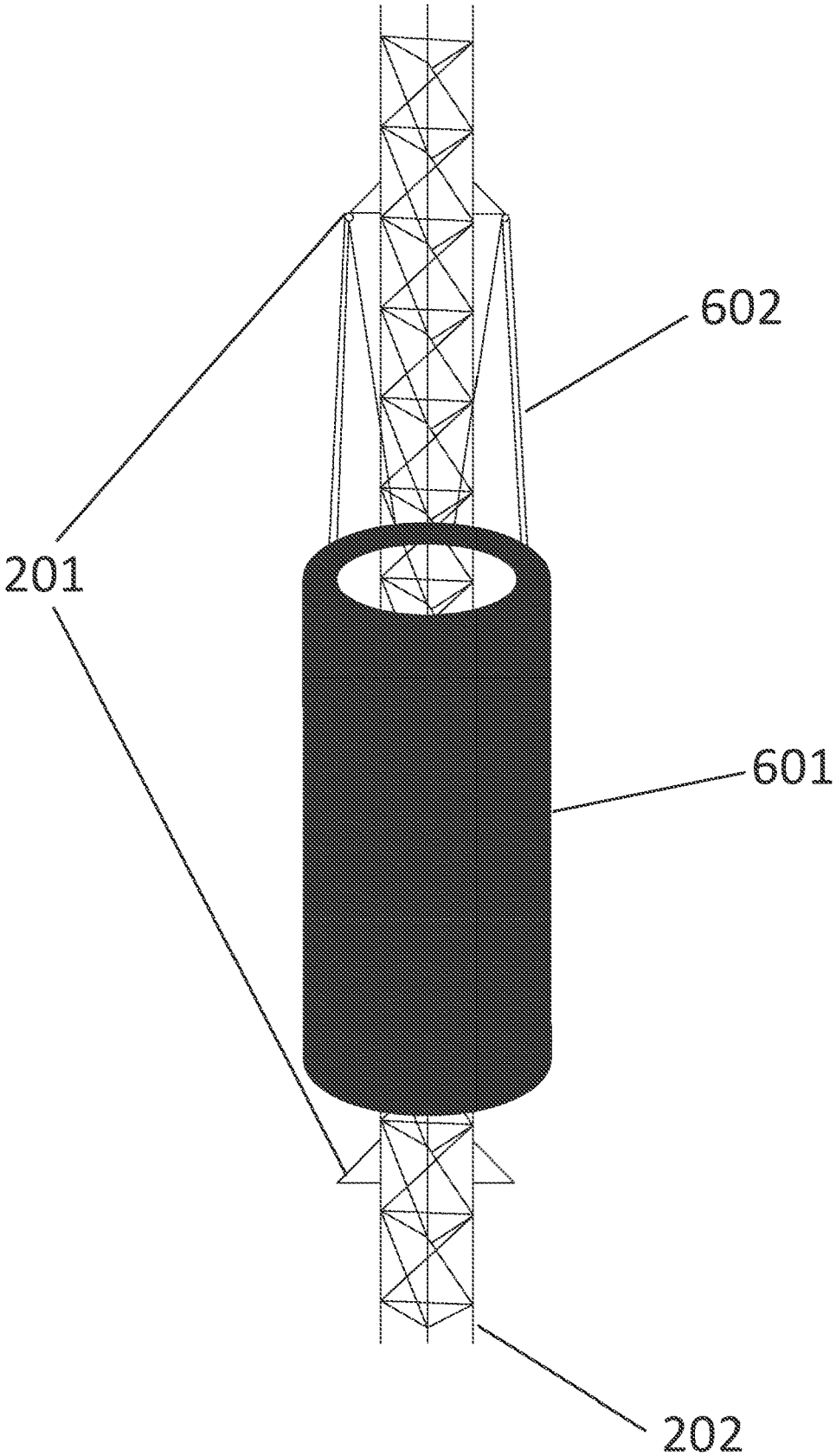
FIG. 9 is a block diagram of a preferred embodiment of the shroud system with the tarp partially raised above a lower boom.

FIG. 9 is a block diagram of a preferred embodiment of the shroud system with the tarp partially raised above a lower boom. FIG. 9 includes vertical structure 202, boom supports 201, tarps 601, and ropes 602.

Figure 10:
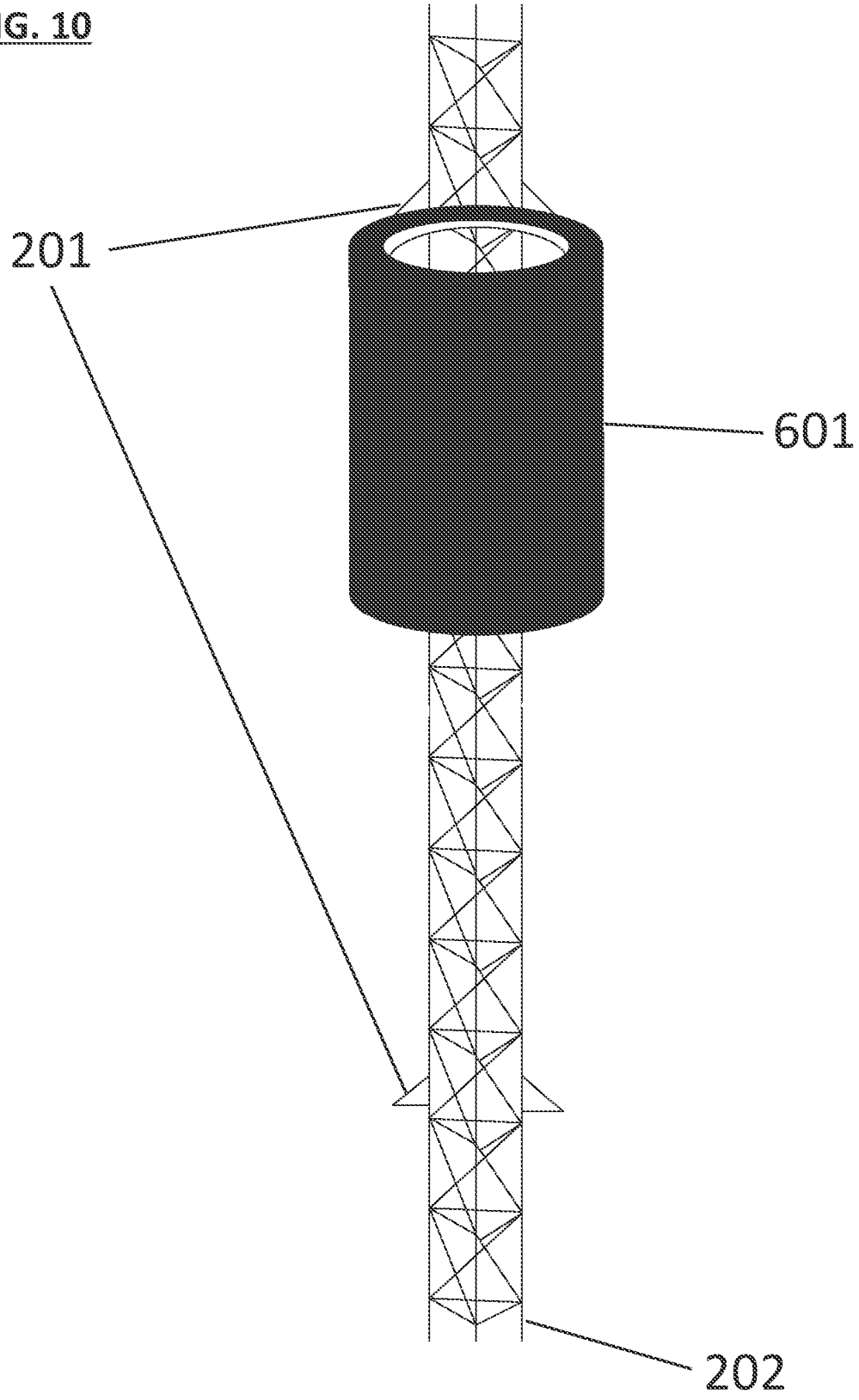
FIG. 10 is a block diagram of a preferred embodiment of the shroud system with the tarp raised to the top set of booms.

FIG. 10 is a block diagram of a preferred embodiment of the shroud system with the tarp raised to the top set of booms. FIG. 10 includes vertical structure 202, boom supports 201, and tarps 601.

Figure 11:
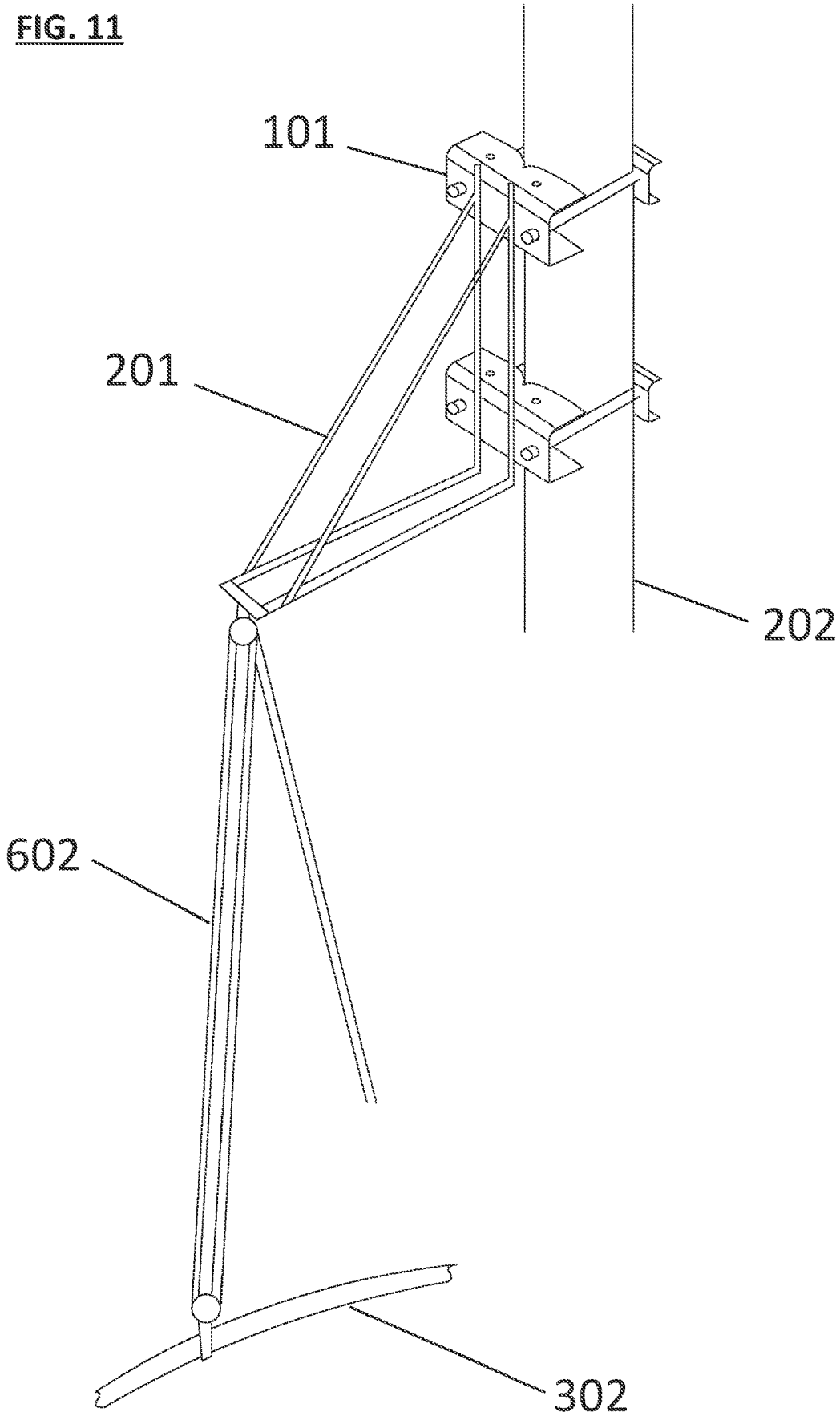
FIG. 11 is a block diagram of a close-up view of a preferred embodiment of the connection between the boom support, tower leg structure, rope and pulley mechanism, and forming structure.

FIG. 11 is a block diagram of a close-up view of a preferred embodiment of the connection between the boom support, leg structure, and forming structure. FIG. 11 includes boom support attachments 101, boom supports 201, vertical structure 202, haul ropes 602, and forming structure segment 302.

In FIG. 11, the boom support is connected to and holds the ropes and pulleys that connect to and hold the forming structures. One or more haul ropes may be attached to a single or plurality of pulleys connected to the boom supports to allow for repositioning of the shroud system.

Figure 12:
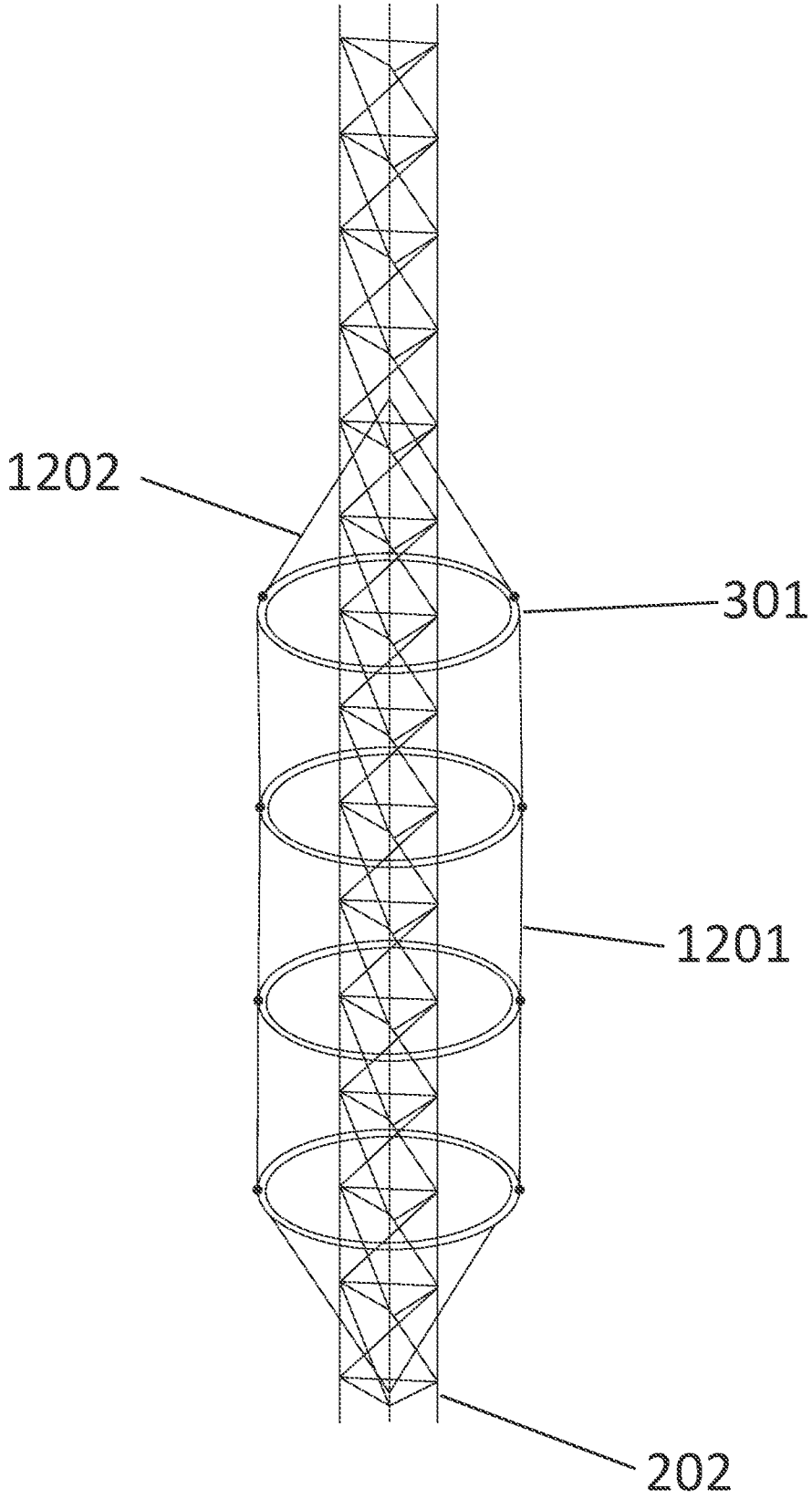
FIG. 12 is a block diagram of a preferred embodiment of a forming structure with no tarp covering.

FIG. 12 is a block diagram of a preferred embodiment of a forming structure with no tarp covering. FIG. 12 includes vertical structure 202, boom supports 201, forming structures 301, knot ropes 1201, and static ropes 1202.

In FIG. 12, the knot ropes are comprised of flexible ropes or equivalent flexible tensile bearing structure, or inflexible rods or beams composed of solid materials including by not limited to metal, plastic, or fiberglass in either a single, rigid pole configuration or consisting of two or more modular segments which may or may not be connected rigidly to allow or prevent folding or collapsing.

In the preferred embodiment, the knot ropes run the entire length of the vertical structure and with the forming structures form the structural backbone of same. The number of knot ropes is variable and is most commonly three to four total.

In the preferred embodiment, the static lines provide guidance of the structure during the collapsing and extension process.

In the preferred embodiment, sections of the structure can be worked on and concealed at a time without encasing the entire structure as one. This allows for the size of the shroud to be elongated or shortened to compensate for wind loads as well.

In alternative embodiments, the shroud system does not contain any knot ropes or forming structures is secured to the vertical structure with knot ropes or by securing the tarps to the structure by any suitable means including but not limited to clipping with carabiners, stapling, chemical adhesion with liquid or tape adhesives, magnetism, tying off with ropes or ties, thermal bonding, nailing, or bolting.

In alternative embodiments, the shroud does not form a contiguous containment over the entire horizontal perimeter of the vertical structure but instead conceals only an isolated portion of the vertical structure. Instead of the tarp being secured to itself at the end seams the tarp is secured and closed at each plane of the vertical seam such that the vertical structure bisects the shroud.

Figure 13:
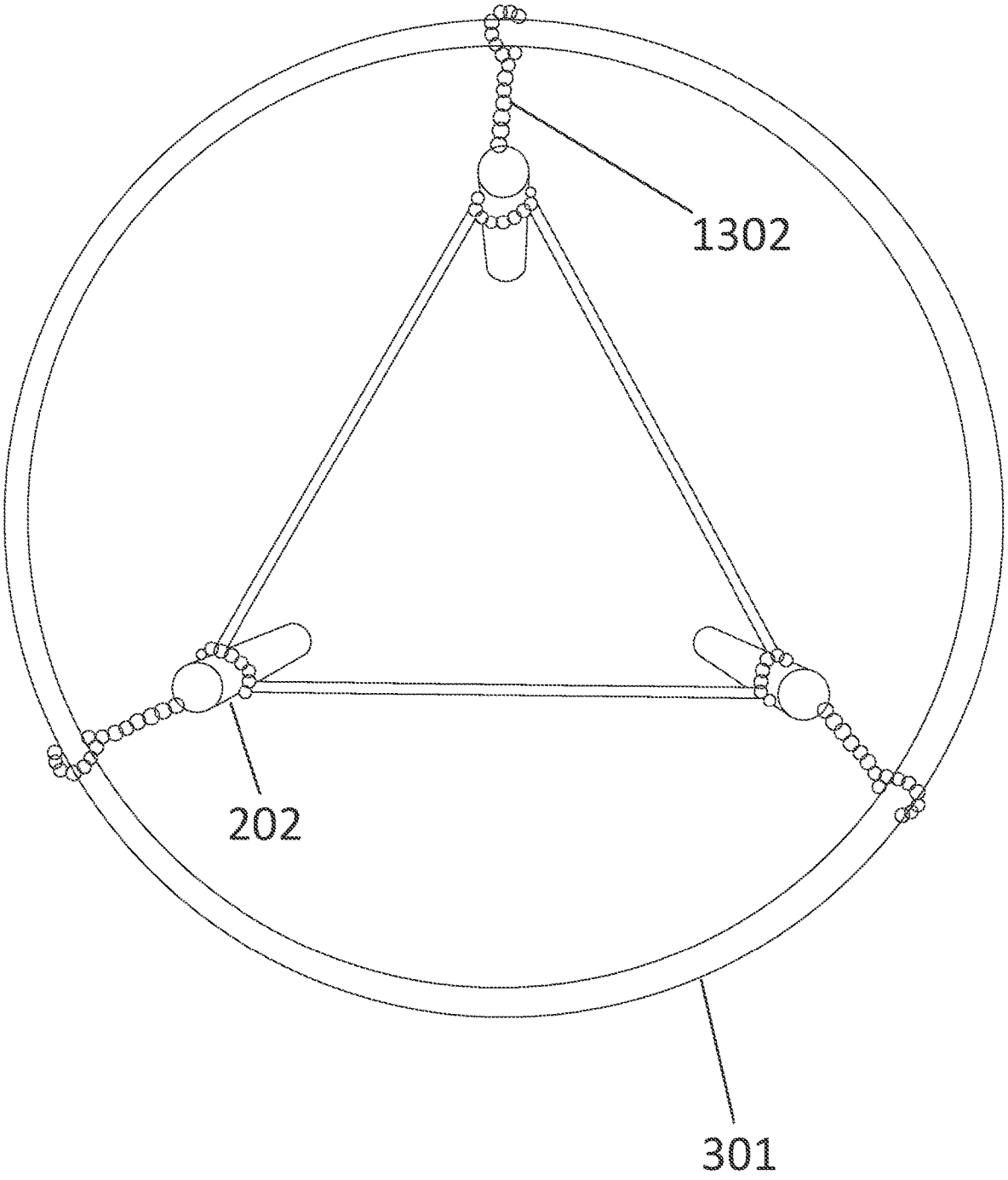
FIG. 13 is a block diagram of a preferred embodiment of a forming structure connected by tension lines to the vertical structure.

FIG. 13 is a block diagram of a preferred embodiment of a forming structure connected by tensioning ropes to a vertical structure. FIG. 13 includes forming structure 301, vertical structure 201, and tensioning ropes 1302.

In FIG. 13, the forming structure may be connected to the tensioning ropes with or without additional suitable means for securing same such as nails, screws, nuts and bolts, zippers, or other fastener that restricts mobility of the forming structure or in a configuration allowing for movement of the forming structure. In the preferred embodiment, the tensioning ropes are attached to the forming structures with a Prusik knot and rope sling.

Figure 14:
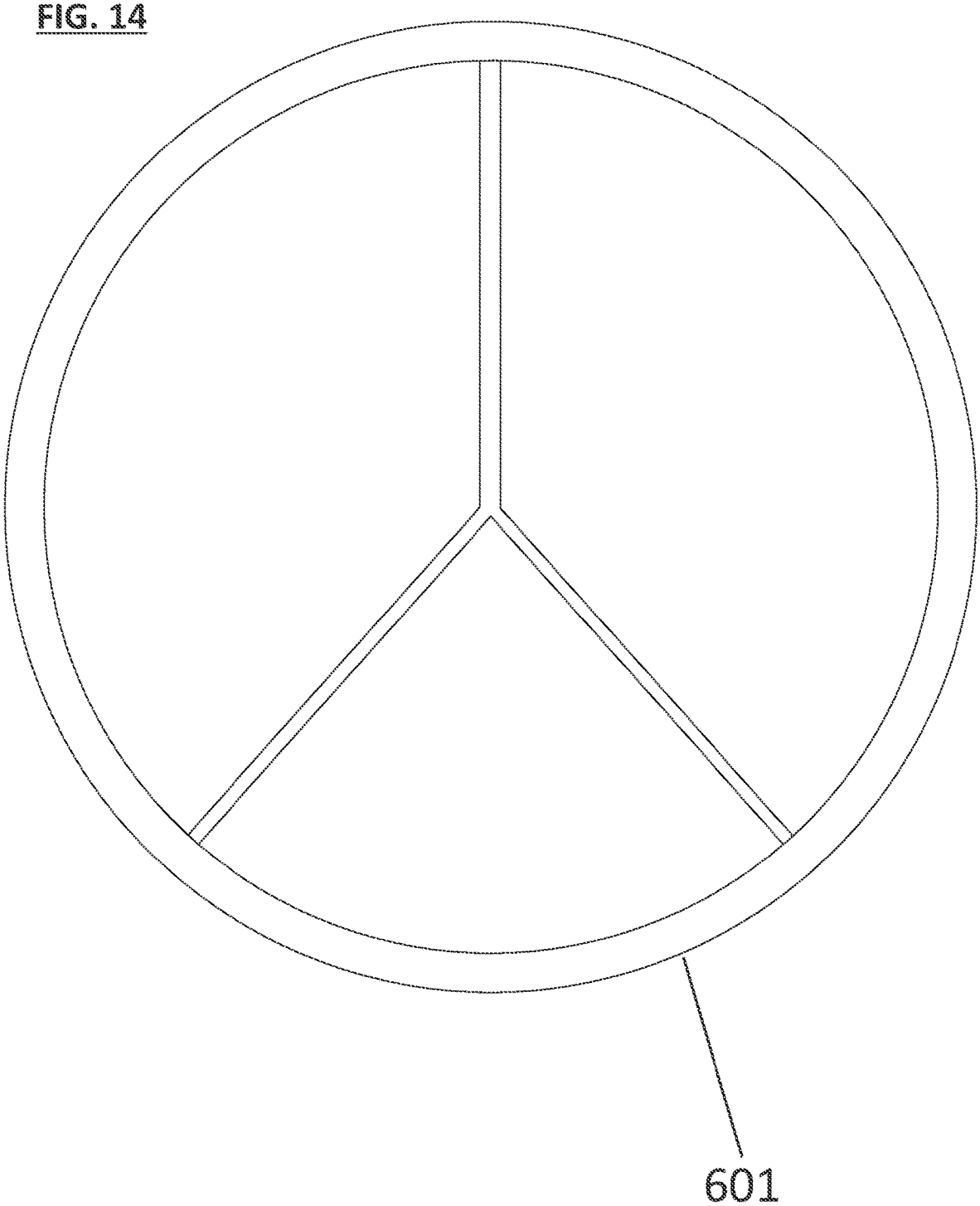
FIG. 14 is a block diagram of a preferred embodiment of tarp panels in a triangular formation used to seal to top and bottom.

FIG. 14 is a block diagram of a preferred embodiment of the bottom or top enclosing tarp panels in a tri-circular formation. FIG. 14 includes two or more tarp panels 601 in a tri-circular shape or shapes.

Figure 15:
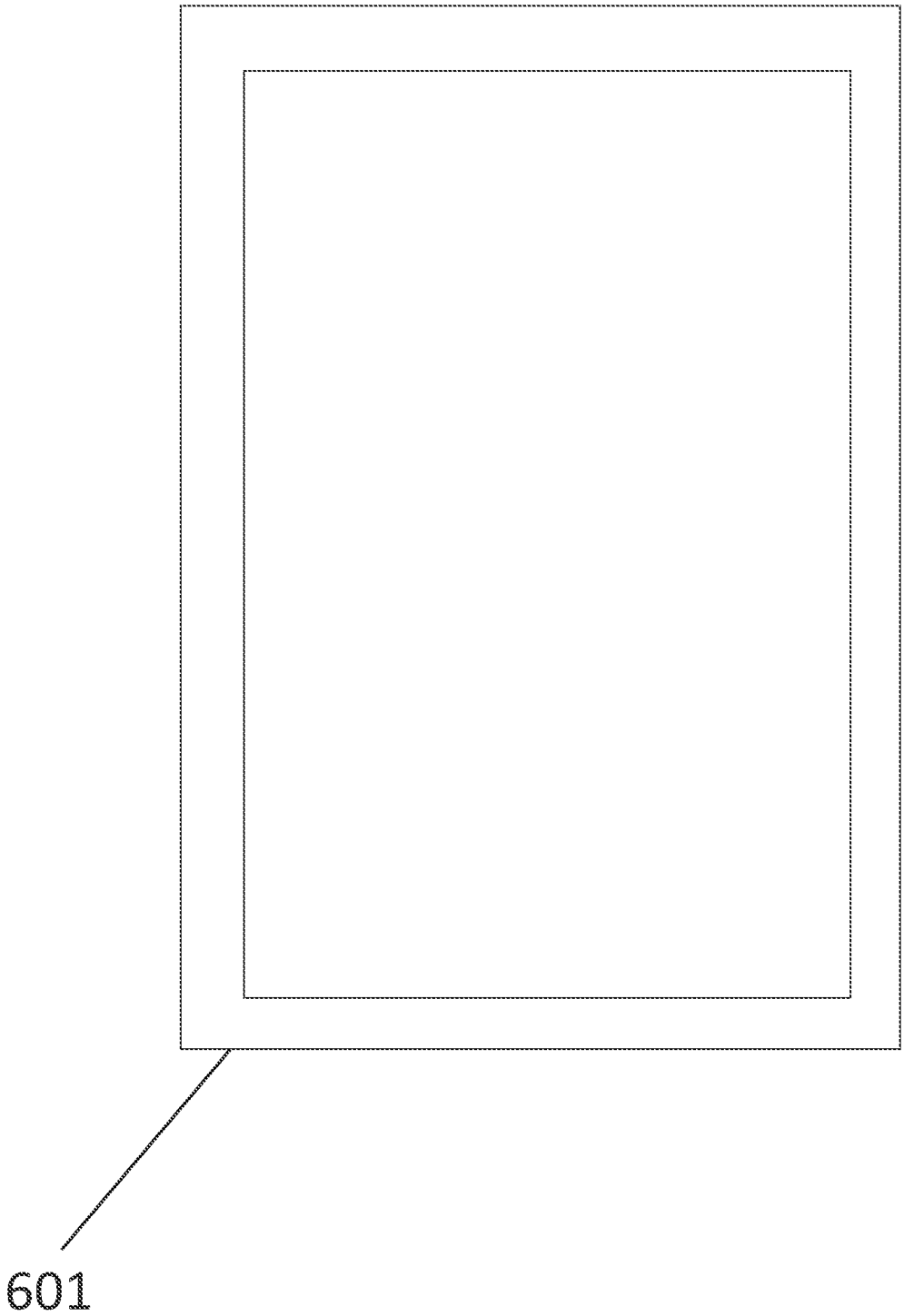
FIG. 15 is a block diagram of a preferred embodiment of tarp panels in a rectangular formation.

FIG. 15 is a block diagram of a preferred embodiment of side tarp panels in a rectangular formation. FIG. 15 includes one or more tarp panels 601 in a rectangular shape or shapes.

In FIGS. 14 and 15, in the preferred embodiment one or more tarps are used to form the enclosing structure of the shroud system. Tarps may be made of any suitable flexible permeable or non-permeable material depending on the desired attributes for each usage. For example, a tarp used to contain paint chips may have perforations to allow air flow, whereas a tarp used to contain a liquid may be non-permeable, or may have both non-permeable and permeable sections. A tarp may be made of fabric, plastic, or any other flexible material that suits the purpose for which it is being used.

In the preferred embodiment, grommets or equivalent fasteners are affixed to various places on the tarps, generally near the edges, which permit the tarps to be attached to one another and to other parts of the system by use of carabiners or other equivalent fasteners.

In FIGS. 14 and 15, in the preferred embodiment the tarp panels are sized and arranged so as to allow at least a 12 inch overlap between the sections. The tarp panels may be secured to each other by any suitable means of connection.

In alternative embodiments, the tarps are "sewn" together with rope or corded up through adjacent grommets.

In alternative embodiments, the tarp is comprised of a single panel connected to itself with a suitable overlap and secured by grommets, carabiners, stitching, stapling, fastened plastic ties, Velcro®, zippers, or other suitable securing mechanism.

In alternative embodiments, the connections between tarp segments are augmented so as to provide additional qualities, such as water retention or rain-proofing. In one embodiment, an additional layer is placed over the seam between the tarp panels and adhered to them by placing tape or nonpermanent adhesive along the edges.

In alternative embodiments, the material used in one section of the tarp is different than that used in another section, and/or one panel may contain multiple materials secured together or layered over each other.

Figure 16:
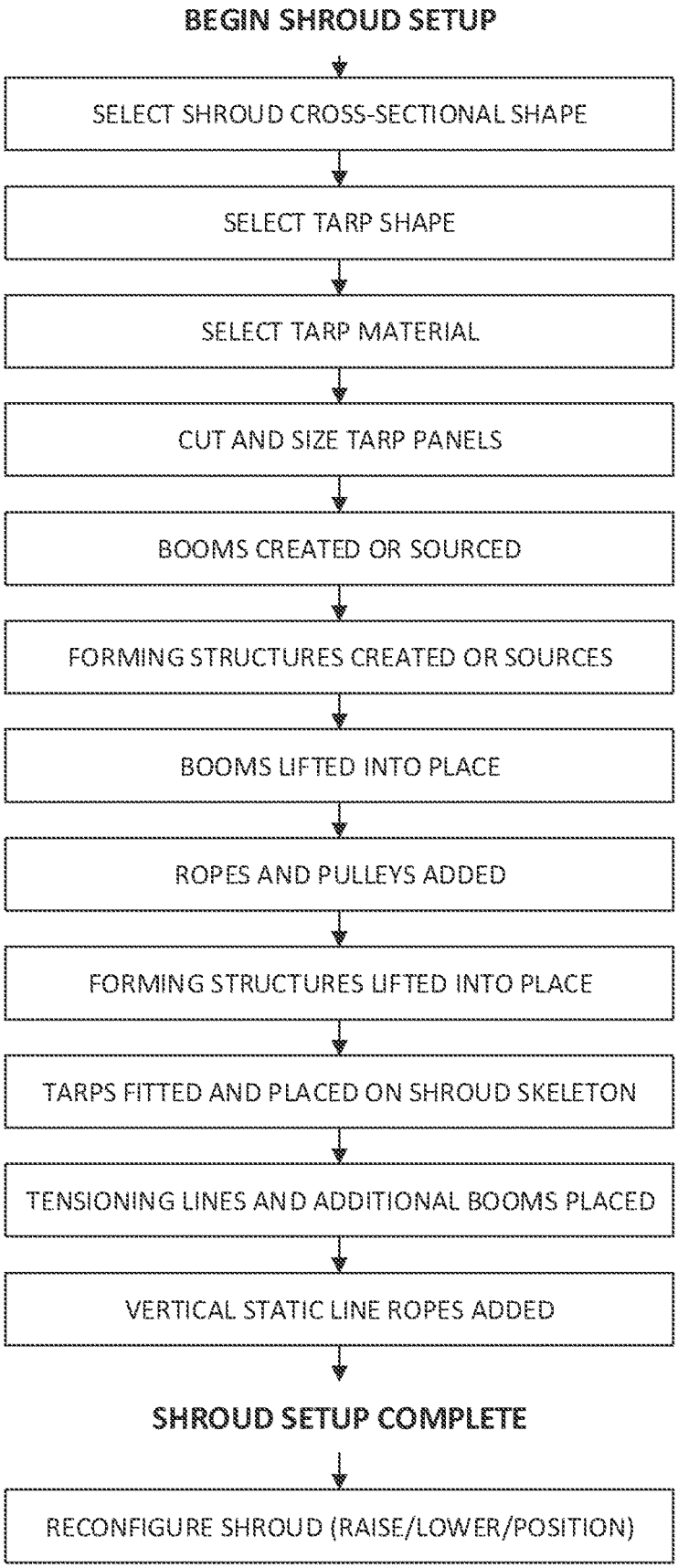
FIG. 16 is a flow diagram of the preferred method of use of the shroud system.

FIG. 16 is a flow diagram of the preferred method of use of the shroud system.

In the preferred method of use, the initial step is comprised of selecting an appropriate shroud cross-sectional shape, an appropriate tarp shape, and an appropriate tarp material or materials.

In the preferred method of use, next tarp panels are sized and cut or procured in one or more panels as determined in the previous step.

In the preferred method of use, next a determination is made whether booms and/or forming structures are to be employed for the intended use. If booms are to be used, same are created or procured to meet the sizing requirements for the intended use. If forming structures are to be used, a determination as to the shape of same and the number of modules to comprise same is made, after which said module or modules are created or procured.

In the preferred method of use, if booms are to be used, same are lifted into place and secured to the vertical structure.

In the preferred method of use, if booms and forming structures are to be used, tied off haul ropes ("short lines") are attached to the booms and the first forming structure is lifted and attached.

In the preferred method of use, if booms and forming structures are to be used, knot ropes are attached to the top forming structure and all additional forming structures are attached to the knot lines.

In the preferred method of use, if booms and forming structures are to be used, the haul lines are attached to the top forming structure, the haul lines are used to lift the structure off the short lines and the short lines are removed.

In the preferred method use, if booms are to be used, same are lifted into place and secured to the vertical structure. If forming structures are to be used, same are moved into place and attached to the boom structures. If no boom structures are to be used, the forming structures are lifted into position and secured to the vertical structure.

In the preferred method of use, if haul ropes and pulleys are to be employed for the intended use same are secured to the shroud including but not limited to at the forming structures and/or booms.

In the preferred method of use, the tarps are lifted into position and secured to the shroud structure and/or the vertical structure.

In the preferred method of use, if tensioning lines and additional booms are to be used same are lifted into place and secured. If vertical static line ropes are to be used same are secured to the shroud structure.

In the preferred method of use the shroud containment system is now fully deployed and completed. The shroud system can thereafter be moved up or down, manipulated in position, collapsed, extended, or shortened.

In an example scenario, in the initial step a cross-sectional shape for the shroud system is chosen. In the preferred embodiment, said shape is round. The diameter is chosen to accommodate the size of the structure being enclosed ensuring a reasonable amount of clearance provided between the tarps and the vertical structure to ensure room for work.

Next, in an example scenario a tarp panel shape and number are chosen including approximately a one foot or more overlap region to ensure full containment. The length of the booms are set also based on the chosen diameter. In the example scenario, the side tarp shape is rectangular and three in number and the bottom and top tarp shapes are tri-circular and three in number.

Next, in an example scenario the tarp material is selected. Factors that are considered include whether the material should be permeable or non-permeable, factoring in necessities such as for air flow against the need or desirability for greater concealment. The chosen material may be either mesh-like or a solid-coated mesh material and prevent of environmental contamination from occurring can be an important determinant. A mesh material for example, would not protect the environment from dust containing lead particles though it would protect from large pieces of paint chips that may be become dislodged from the structure. The material chosen should be based on the specific work to be performed and should account for environmental concerns.

Next, in an example scenario the tarp material is made and/or cut to size based on the vertical structure's height and width with appropriate allowance for excess material to ensure the shroud is capable of being held at a distance from the structure itself as well as providing the previously determined overlap for full containment. In the preferred embodiment, each panel is fitted with double rows of metal grommets along all four sides in order to attach the other panels and to attach a top and a bottom shroud material for total containment. The bottom and top for the shroud is also made into one or more pieces and is cut into shaped pieces with one convexly curved side. These pieces allow for the bottom to close around the structure without being impeded by the vertical structural elements, and meet the cylindrical shape of the sides of the shroud. The grommets along the shroud sides, top, and bottom, are placed to align with the bottom and top shrouds in order to ensure total enclosure. The shroud bottom, top, and sides are then secured together with rope or clipped together with carabiners. Since the carabiners and the rope are not necessarily taking the weight of the shroud, these materials do not necessarily need to be weighted for rigging use.

Next, in an example scenario the booms are made or cut from steel or iron and steel strap bolted together in a triangular truss configuration which are then attached by bolts and nuts to the commercially-available steel universal tower mounts produced by Advanced Tower Products™. Graded eyebolts are added to the end of the boom to provide a means to attach the requisite pulleys for hauling the shroud system. The booms temporarily attach to the vertical structure and have the ability to be relocated and moved by personnel or machine. The preferred embodiment utilizes the Universal Tower Mount, though other mounting devices may be used which are common in the art.

Next, in an example scenario the forming structures are then made or cut of heavy-gauge steel tubing cut to lengths that provide a reasonable number of sections. Coupling sleeves, also made of heavy-gauge steel tubing in the preferred embodiment with an inner diameter slightly larger than the outer diameter of the forming structure tubing, are slid and welded in place on the ends. These sections are bent into semi-cylindrical shape to meet the circumference of the shroud once assembled together. The sections are joined together with either bolts through the coupling sleeves or with bolts used in a set screw configuration. In the case of the set screw configuration additional provisions are made to ensure positive capture of the two sections should the set screw become loose. A minimum of two forming structures are required in order to ensure that the shroud's shape is not compromised. Additional forming structures can be used in the shroud system and provide extra support and rigidity.

Next, in an example scenario the booms are lifted into place on the vertical structure legs. The vertical structure legs are the typically cylindrical solid pieces of structure that run the entire height of the vertical structure. The booms are spaced according to the size of the tarps. The booms must be sufficiently above the highest possible point of the shroud and the lowest possible point of the shroud. The booms are mounted on the vertical structure where one wishes the top of the shroud to be. Additional booms can be mounted on the vertical structure legs to provide additional connection points for transitioning the shroud from one location to another. Once the booms are in place a double pulley is attached to the boom eyebolt and a short rope with fixed loops on both sides is attached to the pulley in preparation for attachment of the forming structures.

Next, in an example scenario the top forming structure is lifted into place and attached to the short rope on the pulley. Once in place the knot rope is attached to the forming structure by the use of a Prusik or other appropriate knot. Additional forming structures are then lifted into place and fixed to their respective vertical locations along the knot rope by the use of a Prusik or other appropriate knot.

Next, in an example scenario haul ropes are added between the top forming structure and double pulleys. Additional pulleys can be added to the haul lines to provide additional leverage as needed depending on the overall weight of the system. At this point one can use the haul lines to lift the shroud structure off the short ropes and remove the short ropes from the system so that the system can be extended vertically. The shroud skeleton, which constitutes all of the elements of the shroud structure without the shroud itself, is then hoisted vertically into its desired location and the upper and lower tails of the knot lines are pulled and tied off tight to create the desired vertical stability of all forming structures.

Next, in an example scenario the tarps are fitted to the shroud skeleton system. Each individual panel is lifted to the top forming structure and attached it at the desired location. These tarps are then secured together to form a continuous surface over the forming structures. Following this the top triangular tarps, which are attached to the side panels, are pulled together at each triangle apex and secured to one another thus enclosing the top. The same procedure is followed for the bottom tarps.

Next, in an example scenario tensioning ropes are attached to the forming structures to provide transverse rigidity to the shroud system. In the preferred embodiment, additional tensioning ropes are added between the vertical structure and the forming structure to further secure the shroud systems against horizontal motion with the use of a trucker's hitch or other appropriate knot. The additional booms are added to the vertical structure and attached directly to the forming structure to provide the same benefit with the use of a square or other appropriate knot.

Next, in an example scenario vertical ropes called static lines are added along the length of the structure at the location of the booms to allow for more rapid extension and collapse.

Next, in an example scenario the shroud system is raised, lowered, transitioned, collapsed, or reconfigured in place during the course of the work being performed. Prior to most actions, however, the top and bottoms are opened as necessary. Raising, lowering, transitioning, collapsing, or reconfiguring is then done using a combination of the haul lines, the additional transitioning booms, and tying off various ropes at strategic locations. Once moved, the shroud is secured using the available ropes.

While preferred and alternate embodiments have been illustrated and described, as noted above, many changes can be made without departing from the spirit and scope of the Containment Shroud System. Accordingly, the scope of the Containment Shroud System not limited by the disclosure of these preferred and alternate embodiments. Instead, the scope of the Containment Shroud System be determined entirely by reference to the claims. Insofar as the description above and the accompanying drawings (if any) disclose any additional subject matter that is not within the scope of the claims below, the inventions are not dedicated to the public and Applicant hereby reserves the right to file one or more applications to claim such additional inventions.

The reader's attention is directed to all papers and documents which are filed concurrently with this specification and which are open to public inspection with this specification, and the contents of all such papers and documents are incorporated herein by reference.

All the features disclosed in this specification (including any accompanying claims, abstract, and drawings) may be replaced by alternative features serving the same, equivalent or similar purpose, unless expressly stated otherwise. Thus, unless expressly stated otherwise, each feature disclosed is one example of a generic series of equivalent or similar features.

Any element in a claim that does not explicitly state "means for" performing a specified function, or "step for" performing a specific function is not to be interpreted as a "means" or "step" clause as specified in 35. U.S.C. § 112 ¶6. In particular, the use of "step of" in the claims herein is not intended to invoke the provisions of U.S.C. § 112 ¶6.

What is claimed is:

1. A shroud system for a separate vertical structure, comprising:

a plurality of boom supports deployable in a first configuration, the boom supports in the first configuration attachable to first positions along one or more sides of the separate vertical structure, the plurality of boom supports deployable in a second configuration, the boom supports in the second configuration attachable to second positions along the one or more sides of the separate vertical structure;

a plurality of tarp panels configurable to shroud and surround at least a vertical portion of the separate vertical structure between the first positions and the second positions;

a plurality of pulleys for attaching the tarp panels to the boom supports; and wherein in use, the plurality of boom supports are vertically moveably attachable to a side of the separate vertical structure between the first positions and the second positions.

2. The shroud system of claim 1, wherein the plurality of tarp panels are attached to one or more forming structures, which are attached via the plurality of pulleys to the plurality of boom supports, the forming structures comprising a plurality of connected segments comprised of a rigid material.

3. The shroud system of claim 1, wherein said plurality of boom supports comprise a plurality of connected segments of a rigid material, and wherein each boom support is secured to the separate vertical structure at one of the first positions or second positions along the side of the separate vertical structure.

4. The shroud system of claim 1, wherein the plurality of tarp panels comprise a plurality of paneled sheets comprised of flexible materials.

5. The shroud system of claim 1, further comprising a plurality of ropes arranged vertically along the plurality of tarp panels and secured to a plurality of forming structures, said forming structures further comprising a plurality of connected segments of a rigid material.

6. The shroud system of claim 1, further comprising a plurality of cables arranged vertically along the plurality of tarp panels and secured to a plurality of forming structures, said forming structures further comprising a plurality of connected segments of a rigid material.

7. The shroud system of claim 1, wherein the plurality of tarp panels are secured together to form a contiguous enclosed shape surrounding the vertical portion of the separate vertical structure.

8. The shroud system of claim 1, comprising additional tarp panels for enclosing a top and/or bottom of the shroud system.

9. The shroud system of claim 1, wherein the plurality of tarp panels are secured to the separate vertical structure to form an enclosure surrounding the vertical portion of the separate vertical structure.

10. The shroud system of claim 1, wherein each of the plurality of tarp panels extends between two adjacent boom supports.

11. The shroud system of claim 1, further comprising a plurality of haul ropes secured to the plurality of boom supports, a plurality of forming structures, and the plurality of tarp panels.

12. The shroud system of claim 1, further comprising a plurality of knot ropes which are secured to a plurality of forming structures.

13. The shroud system of claim 1, further comprising a plurality of tensioning ropes securing a plurality of forming structures to the separate vertical structure.

14. The shroud system of claim 1, further comprising a plurality of static ropes securing a plurality of forming structures during raise, extension, and collapse of the shroud system.

15. The shroud system of claim 1, wherein a plurality of haul lines are connected through said plurality of pulleys, said pulleys secured to a plurality of forming structures and said boom supports.

16. The shroud system of claim 1, wherein each boom support is moveably attachable to a side of the separate vertical structure continuously along at least a portion of the side.

17. The shroud system of claim 1, wherein each boom support is moveable by the removal of only one bolt.

* * * * *